US008326134B2

(12) United States Patent
Harper

(10) Patent No.: US 8,326,134 B2
(45) Date of Patent: Dec. 4, 2012

(54) INTEGRATED BOILER COMPONENT WIRING ASSEMBLY AND METHOD

(76) Inventor: James T. Harper, Eagle, CO (US)

( * ) Notice: Subject to any disclaimer, the term of this patent is extended or adjusted under 35 U.S.C. 154(b) by 799 days.

(21) Appl. No.: 12/510,091

(22) Filed: Jul. 27, 2009

(65) Prior Publication Data

US 2011/0019980 A1 Jan. 27, 2011

(51) Int. Cl.
*H05B 3/60* (2006.01)
*A21D 6/00* (2006.01)

(52) U.S. Cl. ..... 392/312; 426/237

(58) Field of Classification Search ..... 392/311–338; 426/237–248; 174/549
See application file for complete search history.

(56) References Cited

U.S. PATENT DOCUMENTS

| | | | | | |
|---|---|---|---|---|---|
| 1,448,510 | A | * | 3/1923 | Armstrong | 392/312 |
| 1,639,310 | A | | 8/1927 | Richardson | |
| 2,263,549 | A | * | 11/1941 | Yvan | 392/312 |
| 2,307,230 | A | | 1/1943 | Morten | |
| 2,340,354 | A | * | 2/1944 | Wells | 426/243 |
| 3,763,401 | A | | 10/1973 | Ransom | |
| 4,374,714 | A | * | 2/1983 | Hekal | 426/239 |
| 4,863,100 | A | | 9/1989 | Erhardt et al. | |
| 4,902,446 | A | * | 2/1990 | Erbse et al. | 588/16 |
| 5,063,473 | A | | 11/1991 | Hall et al. | |
| 5,390,660 | A | | 2/1995 | Danielson | |
| 5,636,317 | A | * | 6/1997 | Reznik | 392/312 |
| 6,053,416 | A | | 4/2000 | Specht et al. | |
| 6,345,770 | B1 | | 2/2002 | Simensen | |
| 6,741,442 | B1 | | 5/2004 | McNally et al. | |
| 7,141,891 | B2 | | 11/2006 | McNally et al. | |
| 2005/0257843 | A1 | | 11/2005 | Simensen et al. | |
| 2005/0258264 | A1 | | 11/2005 | Simensen et al. | |
| 2006/0062035 | A1 | | 3/2006 | Cutler | |
| 2011/0019980 | A1 | * | 1/2011 | Harper | 392/312 |
| 2012/0073502 | A1 | * | 3/2012 | Volf et al. | 118/725 |

FOREIGN PATENT DOCUMENTS

DE 3137830 A1 3/1983

* cited by examiner

*Primary Examiner* — Daniel L Robinson
(74) *Attorney, Agent, or Firm* — John R. Ley

(57) ABSTRACT

An integrated wiring assembly electrically connects components of a multi-zone boiler heating system. The integrated wiring assembly includes a plurality of connection terminals which are commonly connected to facilitate connecting thermostats and zone valves for each zone, end switches of each zone valve to a start switch of the boiler, and a transformer to supply electrical power to the components, in such a way that the complexity of the electrical connections is simplified.

11 Claims, 6 Drawing Sheets

INTEGRATED BOILER COMPONENT WIRING ASSEMBLY AND METHOD

This invention relates to electrically connecting together various components of a boiler heating system. More particularly, the present invention relates to a new and improved integrated wiring assembly and method which greatly facilitates electrically connecting the components of the boiler heating system and which aids in more quickly diagnosing problems associated with the components of the boiler heating system.

BACKGROUND OF THE INVENTION

Boiler heating systems are widely used to heat residential and commercial buildings. A typical boiler heating system includes a boiler, pipes, radiators and water or similar heat transfer fluid. The boiler generates heat from a heat source, such as a resistive heating element or a combustion chamber in which fuel is burned. The heat is transferred to the water, and the heated water is then pumped through supply pipes to radiators located within the interior of a building. Heat from the heated water flowing through the radiators is transferred to the cooler air. The relatively cooler water from the radiator is then returned to the boiler through return pipes to be heated and circulated again through the radiator.

Particular areas of the building, referred to as zones, are heated independently of other zones in the building. Each zone is heated by at least one radiator. A zone valve controls the flow of heated water from the boiler to each radiator in that zone. A thermostat is located in each zone, and the thermostat controls the zone valve for that zone. In this way, each zone valve is controlled independently of the others to allow independent control of the heat within each different zone in the building.

The thermostat and the zone valve for each zone are connected in series with a transformer which provides electrical power to operate those components. The thermostat functions as a temperature responsive switch which closes when the measured temperature of the air falls below a selected temperature and which opens when the temperature is at or greater than the selected temperature. When the thermostat switch closes, electrical power is delivered to the zone valve, causing the zone valve to open, and the open zone valve conducts heated water through the supply pipes to the radiator within the zone. The flow of heated water through the radiator eventually heats up the air within the zone until the temperature of the air within the zone reaches or exceeds the selected temperature. At that point the switch of the thermostat opens, causing the zone valve to close. The closed zone valve terminates the flow of heated water through the radiator. Thus, the thermostat is closed and the zone valve for a particular zone is opened when the temperature within that zone is less than the selected temperature, and the thermostat is open and the zone valve for the particular zone is closed when the temperature within the zone is at or greater than the selected temperature. In this manner, the temperature in each particular zone is regulated and maintained at approximately the selected temperature.

The boiler may include a hot water storage tank in which a supply of hot water is always maintained. The boiler may also heat the hot water for delivery to the radiators whenever hot water is requested by a thermostat. The boiler includes a start switch which activates both the heat source and an internal pump to circulate the heated water. In a situation where the boiler includes a hot water storage tank, the start switch activates the internal pump to circulate the heated water through the zone valves to the radiators, and a separate thermostatic switch associated with the hot water storage tank may control the heat source of the boiler. In the situation where the boiler heats the hot water when the thermostat requests heat, the heat source of the boiler and the internal pump are activated simultaneously by the start switch. An end switch is connected to each zone valve, and the end switch closes when the zone valve is opened. The boiler start switch is connected in parallel with all of the end switches of the all of the zone valves. Connected in this manner, the start switch is closed and the internal pump (and possibly the heat source) are operated when any one of the zone valves is opened by the thermostat.

Properly connecting the end switches, the boiler start switch, the thermostats in each zone and the zone valves is typically one of the most difficult wiring tasks for a technician to learn. Many hours are typically expended in training technicians to properly wire the different components of the boiler heating system. One of the factors that contributes to the difficulty in learning to correctly connect the components of the boiler heating system is a lack of organization of the wires connecting the components. Usually, these wires are not labeled and often must be traced to the boiler start switch, the transformer, the thermostats and the zone valves, in order to determine which wires are connected to what components. Even experienced technicians can spend a significant amount of time determining the wiring configuration. The time spent trying to determine which roles the connecting wires in a boiler heating system play adds extra cost to service calls. The cost to install a typical boiler heating system is also more expensive due to the lack of organization and clear identification of the electrical conductors which connect the boiler heating system components.

SUMMARY OF THE INVENTION

The present invention pertains to an integrated boiler component wiring assembly which facilitates electrically connecting the components of a boiler heating system. The integrated wiring assembly reduces the amount of time required to electrically wire or connect the components of the boiler heating system. Diagnosing problems with the components of the boiler heating system is facilitated due to the organization of the wires and the ease with which electrical wires connected to the integrated wiring assembly can be identified. The costs of training technicians to wire the electrical connections of the boiler heating system components is also substantially reduced, due to the clarity and understanding of the electrical connections of the integrated wiring assembly. The costs of service calls involving malfunctioning components of the boiler heating system should also be reduced as a consequence of not having to trace the electrical conductors connecting the boiler components.

In accordance with these and other considerations, one aspect of the invention involves an integrated wiring assembly for connecting the components of a boiler heating system. The housing includes a elongated body, two opposite end connection sections and a plurality of intermediate zone connection sections between the end connection sections. Each end connection section includes a plurality of end connection terminals, and each zone connection section includes a plurality of zone connection terminals. Internal conductors connect the end connection terminals to the zone connection terminals, with each internal conductor connecting one end connection terminal with one zone connection terminal of each zone connection section. The zone valves and thermostats of one zone are connected to the zone connection terminals associated with each zone. The transformer and the boiler start switch are respectively connected to the end connection terminals to deliver electrical power to the components of each of the zones and to assure control of the boiler from each of the zones.

Another aspect of the invention involves a method of electrically connecting components of a boiler heating system using an integrated wiring assembly having four internal conductors. The method involves using the integrated wiring assembly to connect two leads of a transformer to a first two of the four internal conductors, connecting two leads of a boiler start switch to a second two of the four internal conductors, connecting a thermostat in series with a zone valve, connecting the remaining one lead of each of the thermostat and the zone valve between the first two of the four internal conductors, and connecting an end switch of the zone valve between the second two of the four internal conductors.

A more complete appreciation of the present invention and its scope may be obtained from the accompanying drawings, which are briefly summarized below, from the following detailed description of a presently preferred embodiment of the invention, and from the appended claims.

DETAILED DESCRIPTION

Figure 1:
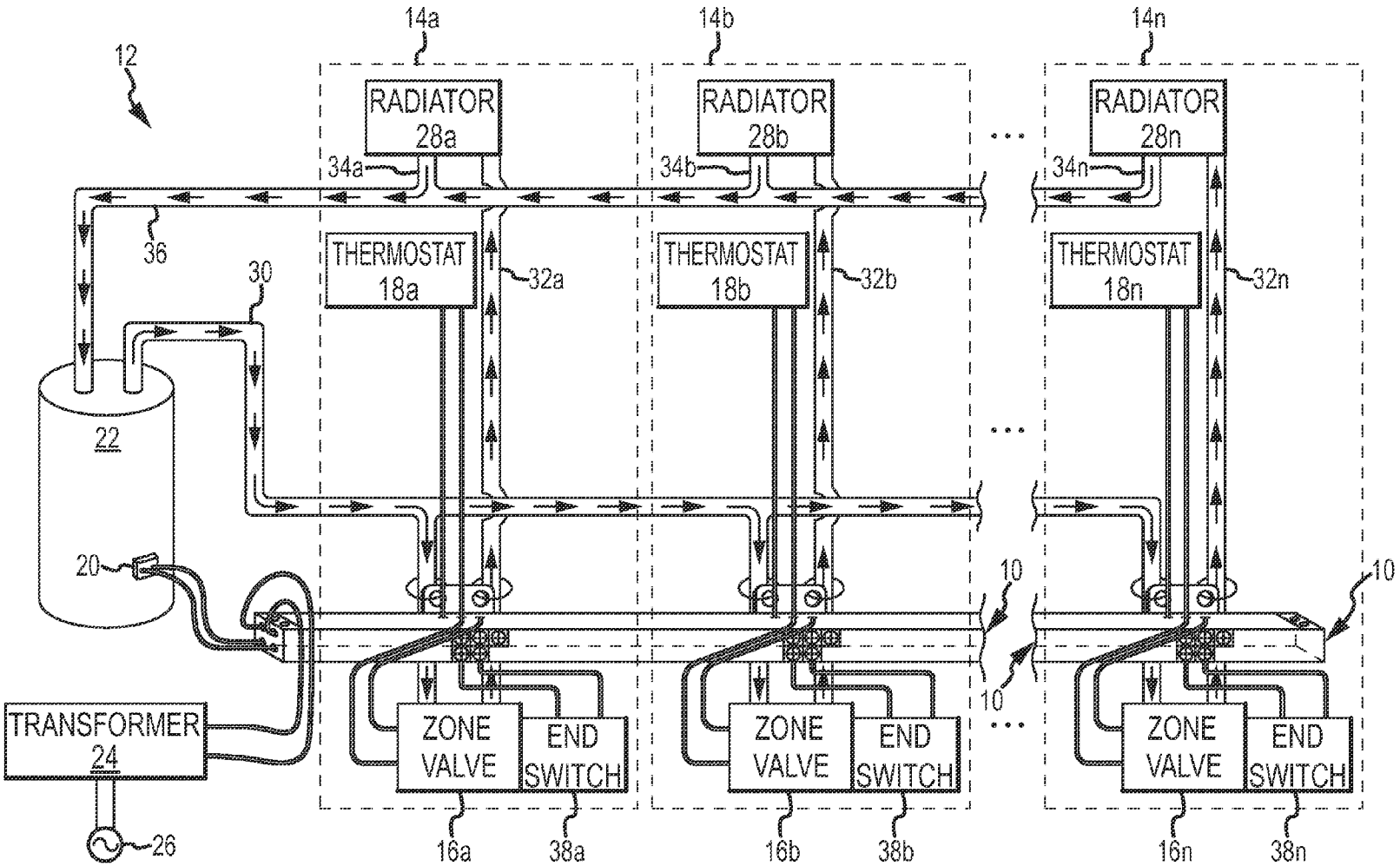
FIG. 1 is a broken perspective view of an integrated wiring assembly embodying the present invention connected to the components of a boiler heating system shown in schematic, perspective and block diagram form.

An integrated wiring assembly 10 which embodies the present invention is shown in FIG. 1. The integrated wiring assembly 10 electrically connects various components of a boiler heating system 12 within a plurality of different zones 14*a*-14*n* of a residential or commercial building (not shown). The boiler components of the heating system 12 include zone valves 16*a*-16*n* and thermostats 18*a*-18*n*, one of each of which is associated with each zone 14*a*-14*n*, and a start switch 20 of a boiler 22 and a transformer 24. The integrated wiring assembly 10 connects these components within each of the zones 14*a*-14*n* and in the boiler system 12 as a whole. The transformer 24 supplies electrical power from commercially available electrical power 26 to the integrated wiring assembly 10. The integrated wiring assembly 10 distributes the electrical power to the zone valves 16*a*-16*n* and thermostats 18*a*-18*n* to cause those components to function independently with respect to each zone 14*a*-14*n*, respectively, and to operate the boiler 22 with the start switch 20, all in a precise, easy-to-understand and organized manner.

At least one radiator 28*a*-28*n* is present in each of the zones 14*a*-14*n*, respectively. The radiators 28*a*-28*n* heat the zones 14*a*-14*n*. The boiler 22 heats the water which is supplied to a hot water supply manifold 30 to each of the zone valves 16*a*-16*n*. The zone valves 16*a*-16*n* open and close to control the supply of hot water to the radiators 28*a*-28*n* through hot water supply pipes 32*a*-32*n*. The thermostats 18*a*-18*n* control the opening and closing of the zone valves 16*a*-16*n*. Heat is extracted from the hot water in the radiators 28*a*-28*n* to heat the air within the zones 14*a*-14*n*. The relatively cooler water leaving the radiators 28*a*-28*n* flows back to the boiler 22 through cold water return pipes 34*a*-34*n* which connect to a cold water return manifold 36.

Electrical power is supplied from the transformer 24 to each of the thermostats 18*a*-18*n* by two internal conductors 56*a* and 56*b* (FIGS. 3, 4 and 6) of the integrated wiring assembly 10. When the temperature responsive switch of each thermostat 18*a*-18*n* closes, electrical power is supplied from the thermostat to open the zone valves 16*a*-16*n* to which each thermostat is connected. Each zone valve 16*a*-16*n* includes an end switch 38*a*-38*n*, respectively. The end switches 38*a*-38*n* are electrically connected in parallel to the boiler start switch 20 by two other internal conductors 56*c* and 56*d* (FIGS. 3, 4 and 6) of the integrated wiring assembly 10. When the thermostat 18*a*-18*n* opens a zone valve 16*a*-16*n*, the end switch 38*a*-38*n* associated with the open zone valve closes to activate the boiler start switch 20. The activated boiler start switch 20 causes the boiler 22 to commence heating water and causes a circulation pump (not shown) to start circulating the hot water through the open zone valve to the radiator and heat the air within the zone. If the boiler 22 includes a hot water storage tank (not shown) the activated boiler start switch 20 causes the circulation pump (not shown) to start circulating the hot water from the storage tank through the open zone valve to the radiator and heat the air within the zone. In the latter circumstance, the boiler 22 commences heating water in the storage tank when the temperature of the water in the storage tank drops below a desired level.

The integrated wiring assembly 10 facilitates creating the aforementioned electrical connections and thereby establishes the functionality between the various components of the boiler heating system 12. The manner in which the integrated wiring assembly accomplishes these functions is explained in connection with the details of the integrated wiring assembly 10 described below.

Figure 2:
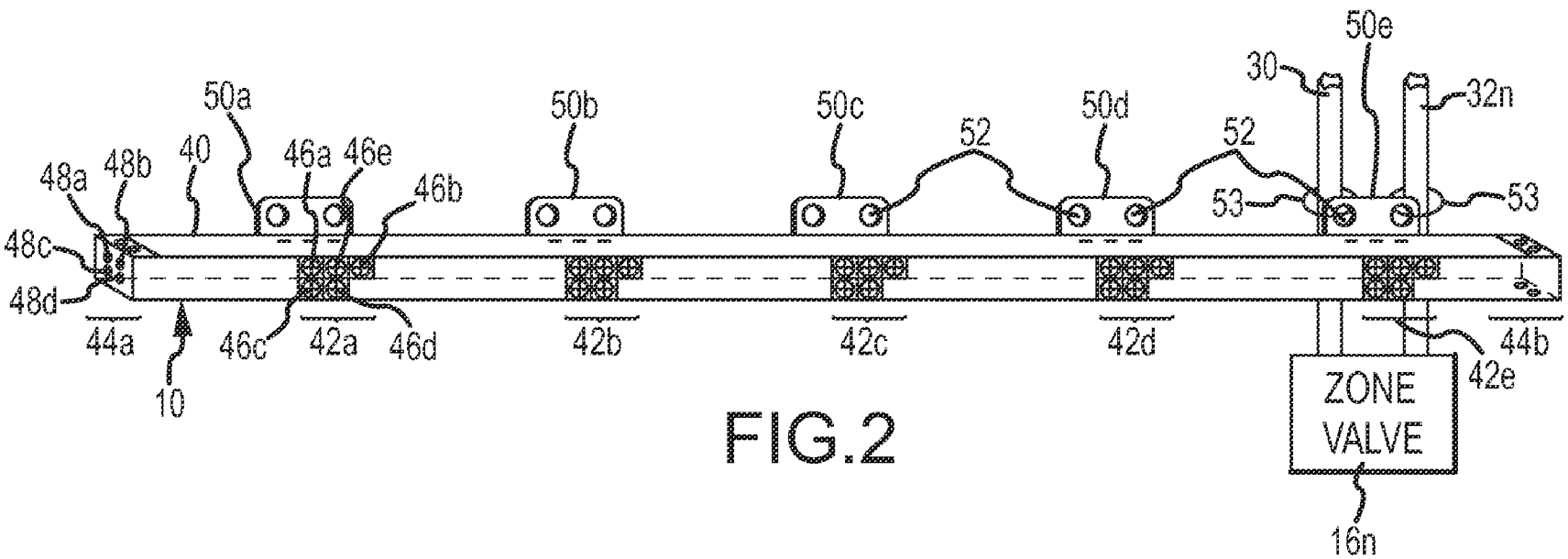
FIG. 2 is a perspective view of the integrated wiring assembly shown in FIG. 1.

The integrated wiring assembly 10, shown in FIG. 2, is formed as an elongated housing 40 which is preferably made of plastic or other non-electrically conducting material. The integrated wiring assembly 10 is generally divided along its length into multiple (five are shown) intermediate zone connection sections 42*a*-42*e* located in the middle of the elongated housing 40, and two end connection sections 44*a* and 44*b* located at opposite ends of the elongated housing 40. The integrated wiring assembly 10 may include more or less than the five zone connection sections 42*a*-42*e* shown in FIG. 2, depending upon the length of the housing 40 and the number of zones to be connected.

Figure 3:
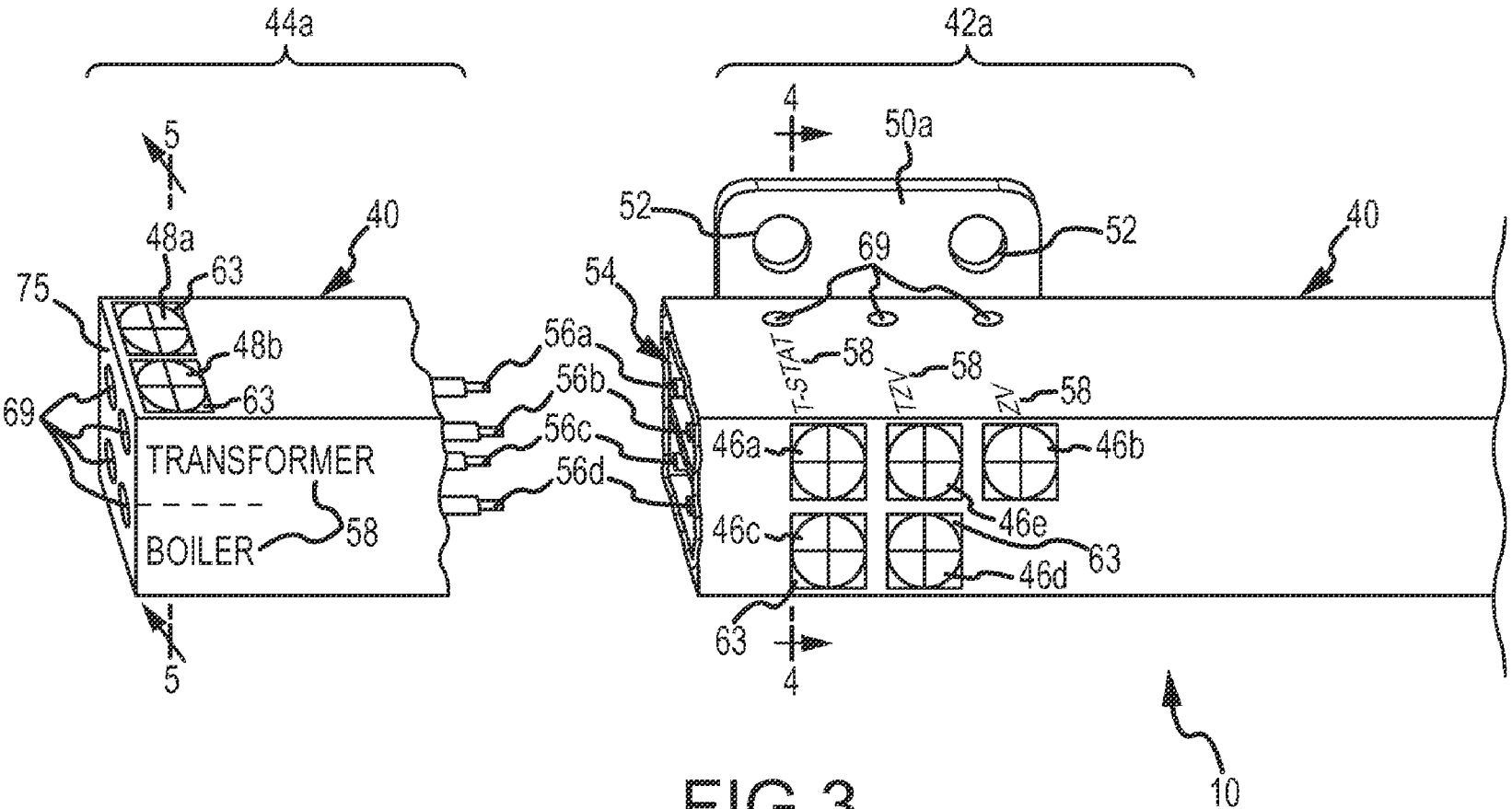
FIG. 3 is a broken perspective view of one end connection section and one zone connection section of the integrated wiring assembly shown in FIGS. 1 and 2.

Each of the zone connection sections 42*a*-42*e* includes five component zone connection terminals 46*a*-46*e*, as shown in FIGS. 2 and 3. Each of the zone connection terminals 46*a*-46*e* electrically connects to electrical conductors extending from the thermostat, the zone valve and the end switch associated with each zone. The two end connection sections 44*a* and 44*b* each include four end connection terminals 48*a*-48*d*. Only the end connection terminals 48*a*-48*d* of one end section, such as end section 44*a*, is needed to connect the integrated wiring assembly 10 to the transformer 24 and to the boiler start switch 20. The end connection terminals 48*a*-48*d* of the other end connection section, end connection section 44*b* for example, can be wired to the end connection terminals 48*a*-48*d* of an end connection section, such as end connection section 44*a*, of a second integrated wiring assembly 10. Proceeding in this manner, multiple integrated wiring assemblies 10 can be daisy chain connected together to accommodate a boiler heating system having more zones than a single integrated wiring assembly 10 can accommodate. Conversely, if only a single integrated wiring assembly 10 is required for a particular boiler heating system, that single integrated wiring assembly 10 need only include one end connection section 44*a* or 44*b* in order to connect to the transformer and boiler start switch.

Mounting tabs 50*a*-50*e* are formed onto the housing 40 of the integrated wiring assembly and facilitate hanging or mounting the integrated housing 10 on the hot water supply manifold 30 and the hot water supply pipes 32*a*-32*n*, as shown in FIG. 2. Each of the mounting tabs 50*a*-50*e* defines openings 52 through which a retaining tie or strap 53 is extended around the supply manifold 30 and the hot water supply pipe 32*n* (FIG. 2) to hold the integrated housing in a desired position at a height that makes working with the integrated housing 10 convenient.

Figure 5:
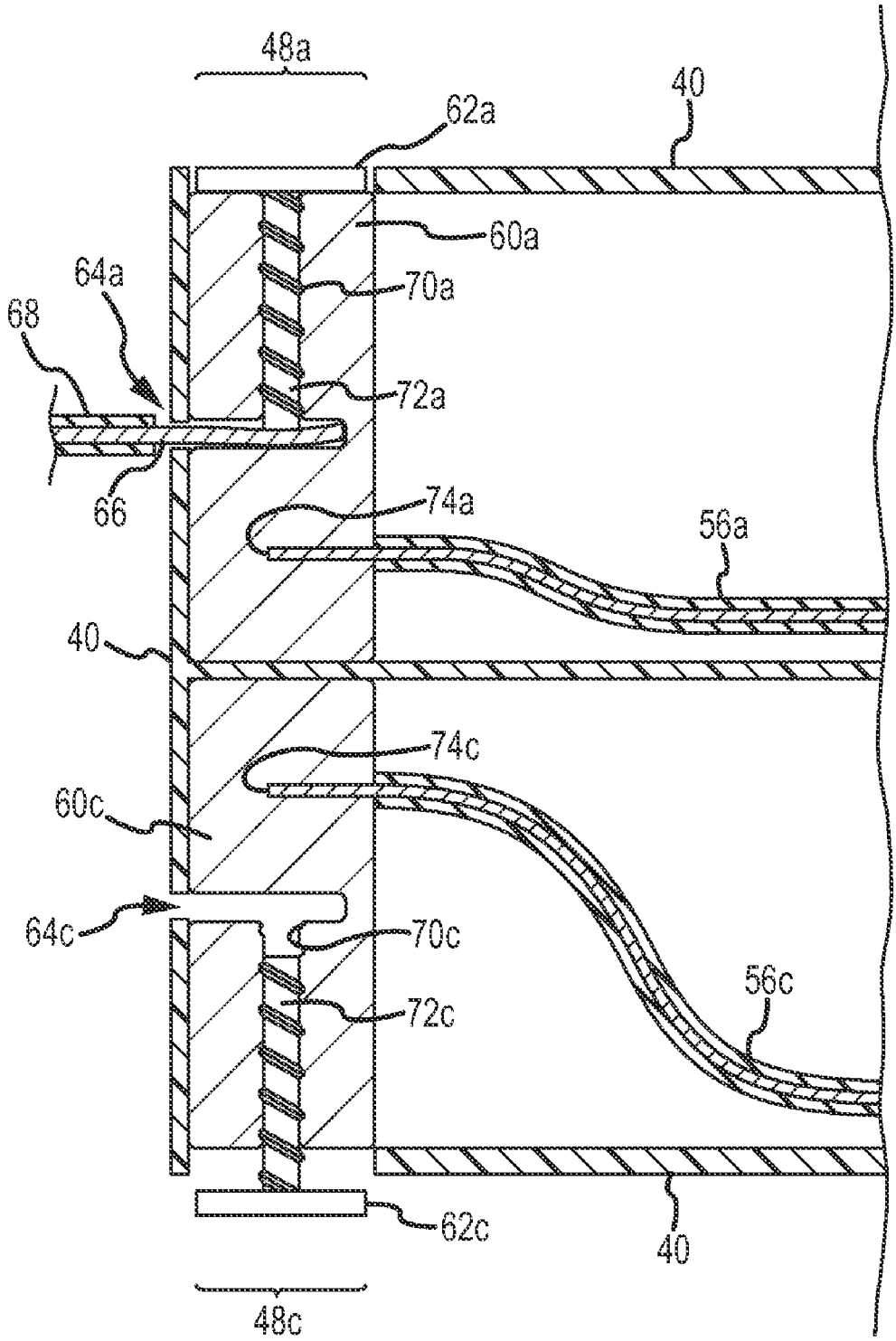
FIG. 5 is a cross-sectional view of the zone connection section of the integrated wiring assembly shown in FIG. 3, taken substantially in the plane of line 5-5.

The housing 40 defines an interior space 54 in which four internal conductors 56*a*-56*d* are located, as shown in FIG. 3. The internal conductors 56*a*-56*d* extend from and electrically connect the end connection terminals 48*a*-48*d* of the end connection section 44*a* (FIGS. 2 and 5) to the corresponding end connection terminals 48*a*-48*d* of the end connection section 44*b* (FIGS. 2 and 5). The internal conductors 56*a*-56*d* are also electrically connected to the zone connection terminals 46*a*-46*d* of each zone connection section 42*a*-42*e*. Specifically, the internal conductor 56*a* electrically connects the end connection terminals 48*a* of both end connection sections 44*a* and 44*b* to the zone connection terminals 46*a* of the intermediate zone connection sections 42*a*-42*e*, the internal conductor 56*b* electrically connects the end connection terminals 48*b* of both end connection sections 44*a* and 44*b* to the zone connection terminals 46*b* of the zone connection sections 42*a*-42*e*, and so on. Indicia 58 which identifies the boiler component leads which attach to the particular zone and end connection terminals 46*a*-46*e* and 48*a*-48*d* are printed, embossed or otherwise attached to the housing 40 adjacent to each of the connection terminals, to thereby facilitate connecting the correct conductors to the terminals.

Figure 4:
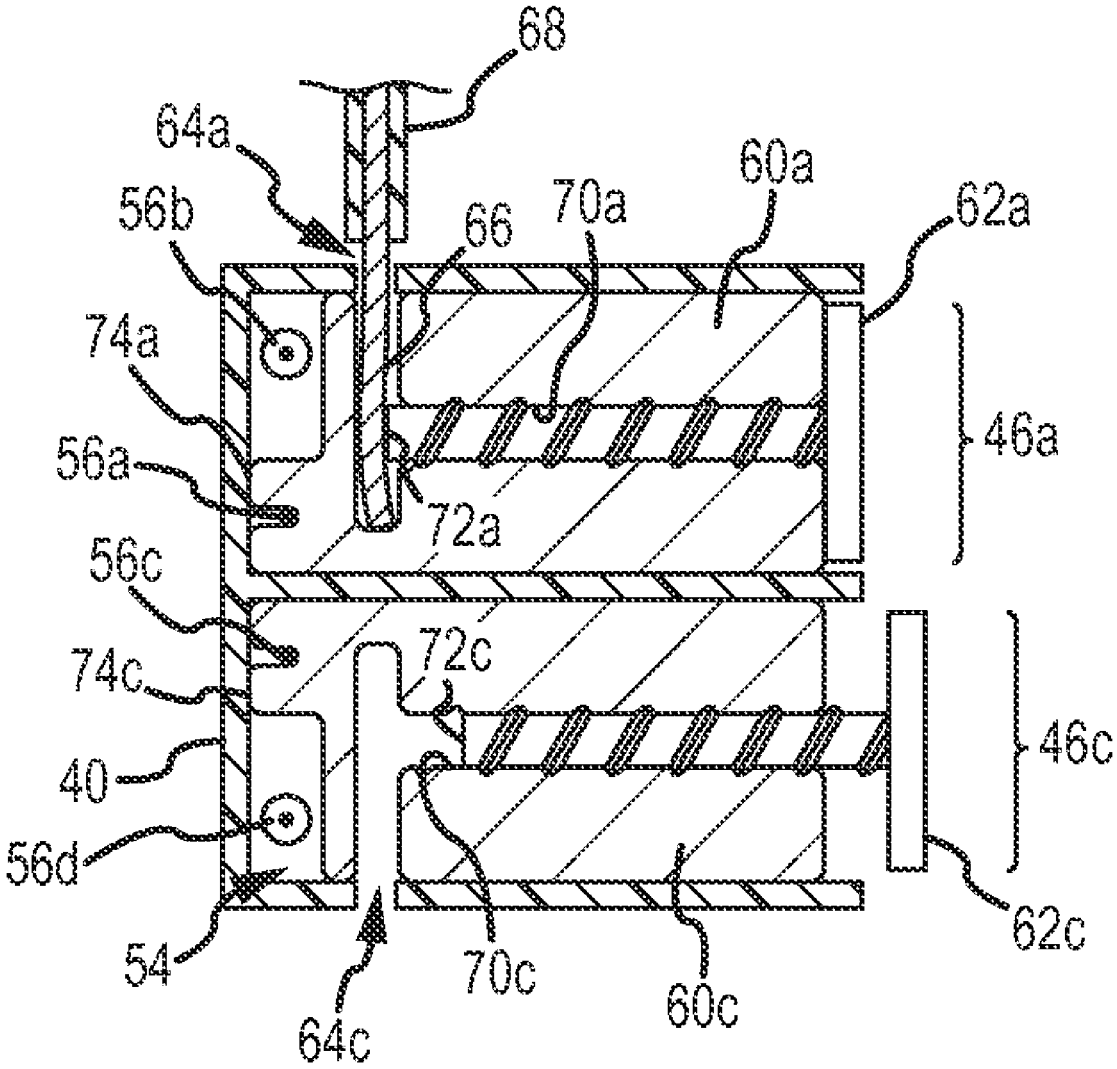
FIG. 4 is a cross-sectional view of the zone connection section of the integrated wiring assembly shown in FIG. 3, taken substantially in the plane of line 4-4.

Two zone connection terminals 46*a* and 46*c*, which are representative of all of the zone connection terminals 46*a*-46*e* of each of the zone connection sections 42*a*-42*e*, are shown in detail in FIG. 4. Each of the zone connection terminals 46*a* and 46*c* includes an electrically conductive terminal body 60*a* and 60*c* which is located and retained within the interior space 54 of the housing 40. Terminal set screws 62*a* and 62*c* extend from of the terminal bodies 60*a* and 60*c*, respectively, and extend through access openings 63 formed in the housing 40. The terminal bodies 60*a* and 60*c* each define a clamping cavity 64*a* and 64*c*, respectively, which receives at least one exposed end 66 of a wire lead 68 or other conductor extending from the components of the boiler heating system 12 which are to be connected by use of the integrated wiring assembly 10. The end 66 of a wire lead 68 is inserted into the clamping cavity 64*a* of the terminal body 60*a* through an access hole 69 formed through the housing 40 in a position which aligns with each clamping cavity 64*a* and 64*c*.

Each of the terminal bodies 60*a* and 60*c* also defines threaded passageways 70*a* and 70*c* which receive the terminal screws 62*a* and 62*c*. Rotation of the set screws 62*a* and 62*c* causes them to move in or out of the threaded passageways 70*a* and 70*c*. The clamping cavities 64*a* and 64*c* intersect the threaded passageways 70*a* and 70*c* in the terminal bodies 60*a* and 60*b*, and allow the ends 72*a* and 72*c* of the terminal screws 62*a* and 62*c* to enter the clamping cavities 64*a* and 64*c*, respectively, when the set screws 62*a* and 62*c* are fully inserted into the threaded passageways 70*a* and 70*c*. Fully inserting the set screws 62*a* and 62*c* causes the ends 72*a* and 72*c* to clamp the exposed ends 66 of the wire leads 68 within the clamping cavities 64*a* and 64*c*, as shown by the end 72*a* of the terminal screw 62*a* clamping the exposed end 66 of wire lead 68. Clamping the exposed end of a wire lead within the clamping cavities 64*a* or 64*c* creates an electrical connection between those wire leads and the respective zone connection terminals 46*a* or 46*c* and also creates a mechanical connection to retain those wire leads in position.

The internal conductors 56*a* and 56*c* within the housing 40 are also electrically connected to the terminal bodies 60*a* and 60*c*, respectively. The internal conductors 56*a* and 56*c* are electrically connected to the terminal bodies 60*a* and 60*c* through conventional splicing mechanisms 74*a* and 74*c* which penetrate through exterior electrical insulation to reach the internal leads of the conductors 56*a* and 56*c*. The Internal conductors 56*a*, 56*b*, 56*c* and 56*d* (FIG. 2) are connected to only one of the terminal bodies at each of the intermediate zone connection sections. As shown in FIG. 4, the internal conductors 56*b* and 56*d* are not electrically connected to the terminal bodies 60*a* or 60*c*, but instead are connected to the terminal bodies corresponding to the zone connection terminals 46*b* and 46*d*.

The zone connection terminal 46*e* does not connect to any of the internal conductors 56*a*-56*d*. Instead, the zone connection terminal 46*e* serves as a junction terminal for connecting a wire lead from the thermostat in series with a wire lead from the zone valve in each zone, as is shown in FIG. 1. To make the junction connection, the exposed ends of the two lead wires from the thermostat in the zone valve are inserted into the single clamping cavity and the terminal set screw is tightened to make the electrical series connection at the zone connection terminal 46*e*.

Two end connection terminals 48*a* and 48*c*, which are representative of all of the end connection terminals 48*a*-48*d* of both end connection sections 44*a* and 44*b*, are shown in detail in FIG. 5. The structural details and operation of each end connection terminal is similar to that of the zone connection terminals 46*a*-46*e* (FIG. 4) previously described. For that reason, the two end connection terminals 48*a* and 48*c* utilize the same electrically conductive terminal bodies 60*a* and 60*c*, terminal set screws 62*a* and 62*c*, access openings 63, clamping cavities 64*a* and 64*c*, access holes 69, threaded passageways 70*a* and 70*b*, set screw ends 72*a* and 72*b* and splicing mechanisms 74*a* and 74*b*. The access hole 69 for the end connection terminals 48*a*-48*d* are formed in an end 75 attached to the end of the housing 40, rather than in the housing 40 itself which is the case for the access holes 69 for the zone connection terminals 46*a*-46*e*.

The end connection terminals 48*a*-48*d* at one end connection section, for example end connection section 44*a* connects to the wire leads or conductors from the boiler start switch 20 and the transformer 24. Consequently, the wire leads 68 shown in FIG. 5 extend from either the start switch 20 or the transformer 24. Also, the internal conductors 56*a*-56*d* within the housing 40 begin and end with the connections to the terminal bodies of the end connection terminals 48*a*-48*d*, respectively. Conventional splicing mechanisms 74*a* and 74*c* make those connections to the ends of the conductors 56*a*-56*d*.

Figure 6:
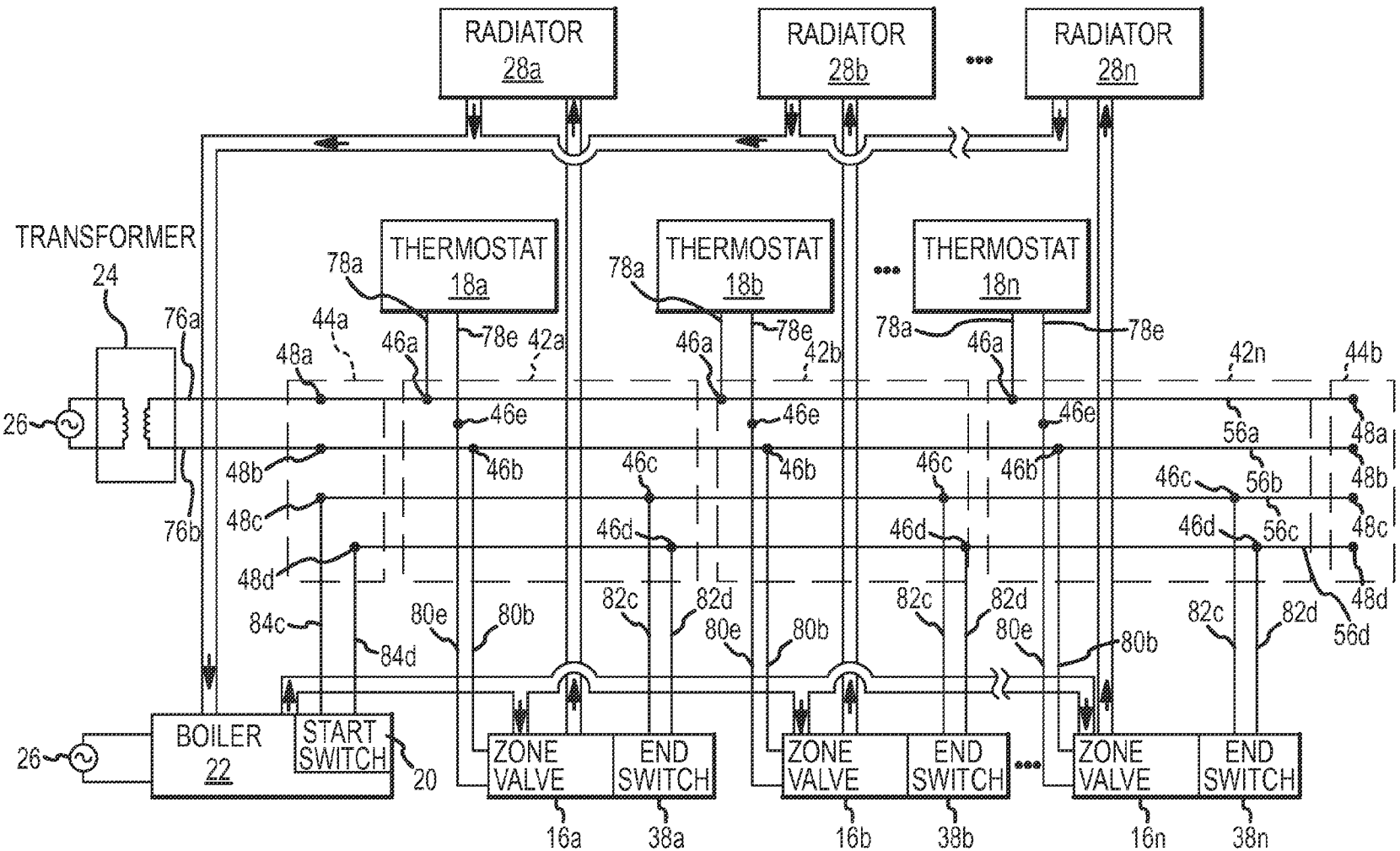
FIG. 6 is a schematic circuit connection diagram of the electrical connections of the boiler components at the end and zone connection sections established by the integrated wiring assembly shown in FIG. 1.

The internal connections of the integrated wiring assembly 10 to the thermostat, zone valves, and end switches is shown in FIG. 6. The transformer 24 is connected to end connection terminals 48*a* and 48*b* of end connection section 44*a* by transformer leads 76*a* and 76*b*. The transformer 24 supplies a voltage potential across the transformer leads 76*a* and 76*b* which is conducted by the internal conductors 56*a* and 56*b*. Each of the thermostats 18*a*-18*n* is connected to the zone connection terminals 46*a* and 46*e* via thermostat leads 78*a* and 78*e*. Each of the zone valves 16*a*-16*n* is connected to the zone connection terminals 46*b* and 46*e* via zone valve leads 80*b* and 80*e*. The zone connection terminals 46*e* electrically connect the leads 78*e* from each of the thermostats 18*a*-18*n* to the leads 80*e* from each of the corresponding zone valves 16*a*-16*n* in each zone.

The end switches 38*a*-38*n* are electrically connected to the zone connection terminals 46*c* and 46*d* via end switch leads 82*c* and 82*d*. The boiler start switch 20 is connected to the end connection terminals 48*c* and 48*d* of end connection section 44*a* by start switch leads 84*c* and 84*d*. Each of the end switches 38*a*-38*n* is open when the corresponding one of the zone valves 16*a*-16*n* is closed. Likewise, each of the end switches 38*a*-38*n* is closed when the corresponding one of the zone valves 16*a*-16*n* is opened. Thus, when any one of the zone valves 16*a*-16*n* is open, an electrical connection is created between the internal conductors 56*c* and 56*d* through the end switch corresponding to that zone valve. The electrical connection between the internal conductors 56*c* and 56*d* when an end switch is closed completes a circuit through the start switch leads 84*c* and 84*d* and starts the boiler 22 and/or its circulation pump.

As an example of operation, the interaction between the various components of the boiler heating system 12 to heat the air within the exemplary zone 14*a* is next described. Similar operation exists with respect to the other zones 14*b*-14*n*. The thermostat 18*a* is preset to a preselected temperature. When the temperature of the air within the zone 14*a* falls beneath that preselected temperature, the internal temperature responsive switch within the thermostat 18*a* closes. Closing the temperature responsive switch causes the voltage potential across the internal conductors 56*a* and 56*b* to be conducted to the zone valve 16*a* which causes the zone valve 16*a* to open. As a result of the zone valve 16*a* opening, the end switch 38*a* closes. The closing of the end switch 38*a* causes an electrical connection between the internal conductors 56*c* and 56*d*, which starts the boiler 22 and/or its circulation pump. The starting of the boiler 22 causes water within the boiler 22 to be heated and also causes the circulation pump to pump the heated water to the hot water supply manifold 30. The heated water flows from the hot water supply manifold 30, through the open zone valve 16*a* and through the hot water supply pipe 32*a* to the radiator 28*a*. Heat is extracted from the heated water flowing through the radiator 28*a* thereby heating the air and cooling the water. The relatively cooler water from the radiator 28*a* flows back to the boiler 22 through the cold water return pipe 34*a* and the cold water return manifold 36.

As more and more heated water flows through the radiator 28*a*, the air within the zone 14*a* gets warmer and warmer until the temperature of the air within the zone 14*a* reaches the preselected temperature of the thermostat 18*a*. When the temperature of the air within the zone 14*a* reaches that preselected temperature, the temperature responsive switch of the thermostat 18*a* opens. Opening the temperature responsive switch of the thermostat 18*a* causes the zone valve 16*a* to close, which causes the end switch 38*a* to open, which in turn causes the start switch 20 to open and the boiler 22 to turn off, provided that none of the other end switches 38*b*-38*n* are still closed. In this manner, the boiler heating system 12 independently heats the various zones 14*a*-14*n* within the building.

The integrated wiring assembly 10 can substantially reduce the amount of time taken by a technician to wire the components of a boiler heating system. The integrated wiring assembly 10 removes the guess-work and confusion often involved when a technician attempts to wire components of a boiler heating system. Time spent training technicians to be proficient at installing and servicing problems with boiler heating systems is a significant cost. Significantly less training time is required for new technicians when they are trained to wire the components of a boiler heating system using the integrated wire housing 10. Use of the integrated wiring assembly 10 to connect the components of a boiler heating system also reduces the risk that a boiler heating system component will be damaged as a result of incorrectly connecting the component to the boiler heating system. The use of the integrated wiring assembly 10 results in a central location at which the electrical components of the boiler heating system are neatly wired. The neat and orderly wiring facilitates speedy problem determination and resolution concerning the boiler heating system. Many other advantages and improvements will become apparent upon fully comprehending the scope and significance of the present invention.

A presently preferred embodiment of the present invention and many of its improvements have been described with a degree of particularity. This description is a preferred example of implementing the invention, and is not necessarily intended to limit the scope of the invention. The scope of the invention is defined by the following claims.

What is claimed:

1. An integrated wiring assembly for use in a multi-zone boiler heating system to electrically connect a thermostat and a zone valve associated with each of a plurality of zones, and to electrically connect a start switch and an end switch associated with each zone valve, and to electrically connect to a transformer of the boiler heating system; the integrated wiring assembly comprising:

a housing which defines an interior space;

an end connection section connected to the housing and operative for connecting to the start switch and the transformer, the end connection section including first, second, third and fourth end connection terminals;

a plurality of zone connection sections connected to the housing and operative for connecting to the thermostat, the zone valve and the end switch of the zone valve at each zone, each zone connection section including first, second, third, fourth and fifth zone connection terminals;

first, second, third and fourth internal electrical conductors within the interior space of the housing, the first internal conductor commonly connecting the first zone connection terminals of each zone connection section and the first end connection terminal of the end connection section, the second internal conductor commonly connecting the second zone connection terminals of each zone connection section and the second end connection terminal of the end connection section, the third internal conductor commonly connecting the third zone connection terminals of each zone connection section and the third end connection terminal of the end connection section, and the fourth internal conductor commonly connecting the fourth zone connection terminals of each zone connection section and the fourth end connection terminal of the end connection section; and wherein:

the first and second end connection terminals are for connecting to two lead conductors of the transformer;

the third and fourth end connection terminals are for connecting to two lead conductors of the start switch;

the first zone connection terminal of each zone connection section is for connecting to one lead conductor from the thermostat in the zone associated with the zone connection section;

the fifth zone connection terminal of each zone connection section is for connecting to another lead conductor from the thermostat in the zone and to one lead from the zone valve in the zone associated with the zone connection section;

the second zone connection terminal of each zone connection section is for connecting to another lead from the zone valve in the zone associated with the zone connection section;

the third zone connection terminal of each zone connection section is for connecting to one lead from the end switch of the zone valve in the zone associated with the zone connection section; and the fourth zone connection terminal of each zone connection section is for connecting to the other lead from the end switch of the zone valve in the zone associated with the zone connection section.

2. An integrated wiring assembly as defined in claim 1, further comprising:

indicia attached to the housing adjacent to the end connection terminals and the zone connection terminals which identifies the lead conductor to be attached to each of the zone and end connection terminals.

3. An integrated wiring assembly as defined in claim 1, wherein:

the housing is elongated;

the end connection section is located at one end of the elongated housing; and each zone connection section is located between the end connection section and the other opposite end of the elongated housing.

4. An integrated wiring assembly as defined in claim 3, further comprising:

a plurality of mounting structures attached to the housing by which to mount the integrated wiring assembly to a support.

5. An integrated wiring assembly as defined in claim 3, further comprising:

another aforesaid end connection section located at the opposite end of the elongated housing; and wherein:

the first, second, third and fourth end connection terminals of the other end connection section connected to the first, second, third and fourth internal conductors, respectively.

6. An integrated wiring assembly as defined in claim 1, wherein:

each of the end and zone connection terminals comprises a terminal body, a clamping member attached to the terminal body by which to connect the lead conductor to the terminal body, and a mechanism which connects the terminal body to an internal conductor.

7. A multi-zone boiler heating system using an integrated wiring assembly as defined in claim 1, comprising:

a boiler for heating heat transfer liquid, the boiler including the start switch;

a plurality of radiators, at least one radiator located in each zone;

a plurality of heat transfer liquid conducting pipes which connect the boiler to all of the zone valves and each zone valve to the radiator of its associated zone and each radiator to the boiler in a fluid circulatory path; and wherein:

the end connection terminals are connected to the lead conductors of the start switch and the transformer; and the zone connection terminals are connected to the lead conductors of the thermostats, the zone valves and the end switches.

8. A method of using an integrated wiring assembly as defined in claim 1 to electrically connect the thermostat and the zone valve in each of zones, and to electrically connect the start switch and the end switch associated with each zone valve, and to electrically connect to a transformer; the method comprising:

connecting the first and second end connection terminals to two lead conductors of the transformer;

connecting the third and fourth end connection terminals to two lead conductors of the start switch;

connecting the first zone connection terminal of each zone connection section to one lead conductor from the thermostat in the zone associated with the zone connection section;

connecting the fifth zone connection terminal of each zone connection section to another lead conductor from the thermostat in the zone and to one lead from the zone valve in the zone associated with the zone connection section;

connecting the second zone connection terminal of each zone connection section to another lead from the zone valve in the zone associated with the zone connection section;

connecting the third zone connection terminal of each zone connection section to one lead from the end switch of the zone valve in the zone associated with the zone connection section; and connecting the fourth zone connection terminal of each zone connection section to the other lead from the end switch of the zone valve in the zone associated with the zone connection section.

9. An integrated wiring assembly for use in a multi-zone boiler heating system to electrically connect components of the boiler heating system, comprising:

a housing which defines an interior space;

an end connection section comprising four end connection terminals, each end connection terminal mounted within the housing and adapted for electrically connecting to a wire further connected to one of the boiler heating system components;

a plurality of zone connection sections, each zone connection section comprising five zone connection terminals, each zone connection terminal mounted within the housing and adapted for electrically connecting to a wire further connected to one of the boiler heating system components;

four internal conductors positioned within the interior space, each of the internal conductors electrically connected to one of the four end connection terminals, each of the internal conductors further electrically connected to one of the four zone connection terminals of each zone connection section; and wherein one of the five zone connection terminals of each zone connection section is not electrically connected to any other connection terminals.

10. An integrated wiring assembly as defined in claim 9, wherein the aforementioned end connection section is a first end connection section, the integrated wiring assembly further comprising:

a second end connection section, the second end connection section comprising four end connection terminals, each end connection terminal mounted within the housing and electrically connected to a different one of the four internal conductors.

11. An integrated wiring assembly as defined in claim 10, further comprising:

indicia attached to the housing adjacent to the end connection terminals and the zone connection terminals which identifies which of the components of the boiler heating system are for connecting to the end and zone connection terminals.

* * * * *